United States Patent [19]

Leopoldi et al.

[11] 4,399,495

[45] Aug. 16, 1983

[54] FLASHLIGHT

[75] Inventors: Norbert Leopoldi, Chicago; William P. Heinrich, McHenry, both of Ill.

[73] Assignee: Cloverline, Inc., Chicago, Ill.

[21] Appl. No.: 384,794

[22] Filed: Jun. 4, 1982

[51] Int. Cl.[3] ..... F21L 7/00

[52] U.S. Cl. ..... 362/189; 362/203; 362/204; 362/205; 362/206; 200/60; 362/802

[58] Field of Search ..... 362/189, 203, 204, 205, 362/206, 202; 200/60

[56] References Cited

U.S. PATENT DOCUMENTS 2,019,884 11/1935 Beaumont ..... 362/189

4,122,510 10/1978 Halliday ..... 362/189

4,237,527 12/1980 Breedlove ..... 362/189

4,347,553 8/1982 Saron ..... 362/189

*Primary Examiner*—Stephen J. Lechert, Jr.

*Attorney, Agent, or Firm*—McWilliams, Mann, Zummer & Sweeney

[57] ABSTRACT

The invention relates to a flashlight that is adapted to be hand held and wherein the circuit to the bulb is completed by merely a squeezing action on the outer tubular shell of the container, which pressure causes a series of lengthwise metal fingers on a clip mounting the bulb, to be brought into contact with the metal can housing the battery and thus energize the bulb.

5 Claims, 5 Drawing Figures

FLASHLIGHT

BACKGROUND OF THE INVENTION

1. Field of the Invention

This invention relates to that field of lighting devices commonly known as flashlights and which are usually hand held for directing a beam of light onto a subject and wherein the light was turned on and off by a built-in switch.

2. Description of the Prior Art

Heretofore, it has been the usual practice to enclose one or more batteries in a cylindrical container, which may have been either metal, or plastic, and in order to energize the bulb it was necessary to actuate an exterior switch on the container to complete a circuit from the metal rear end of the battery can to the bulb, with the anode of the battery normally disposed in contact with the base of the bulb so that when the switch was actuated a circuit was completed to energize the bulb and cause it to light. The battery included an insulating outer cover to avoid grounding in the cylindrical container and the switch was usually of a sliding type, or a push button, or sometimes a combination of the two and so arranged that an energizing circuit to the bulb could only be completed through the switch. Some heavy duty flashlights, or so-called lanterns, used a snap action switch which was operated by a push button located adjacent to a handle on the light which enabled the lantern to be carried by the handle and the switch pressed by the thumb of the hand carrying the unit. In any case, the battery had to be insulated around its outer surface and the circuit to the bulb was completed only from the rear end of the battery through the switch and the central anode bearing against the base of the bulb.

SUMMARY OF THE INVENTION

The present invention provides a hand held flashlight which may be small enough to be carried in a purse, or the like and which incorporates a circuit completing action that involves a mere squeezing action on a flexible container for the unit, to energize the bulb and cause it to light. In this flashlight, the battery does not include an insulating covering but the bare battery can is disposed in the battery container and the rear portion of the container has a resilient pressure device that urges the battery forwardly in the container.

This pressure means may comprise a cotton bat, or a foam packing that is both insulating and compressible whereby it creates a pressure that presses the battery axially into a clip that includes a plurality of metal fingers that extend lengthwise at spaced intervals around the battery. A dielectric ring is disposed around the front end of the battery can to act as an insulation of the negative pole of the battery and to center the battery in the clip. The bulb is mounted in the front end of the flashlight with its base in contact with the battery anode.

The lengthwise fingers are disposed within the outer container of the flashlight and this container is made from a flexible plastic material that has insulating properties and enables this tubular container to be squeezed and thus press the metal fingers into contact with the battery can and thereby complete an electrical circuit to the bulb and result in its being caused to light and stay lit as long as pressure on the flexible plastic container is maintained to hold the metal fingers engaged with the surface of the battery can.

DESCRIPTION OF THE DRAWINGS

The features of the invention heretofore referred to are attained by the flashlight structure and arrangement illustrated in the accompanying drawings wherein.

DESCRIPTION OF PREFERRED EMBODIMENT

Figures 1, 2, 3, 4, 5:
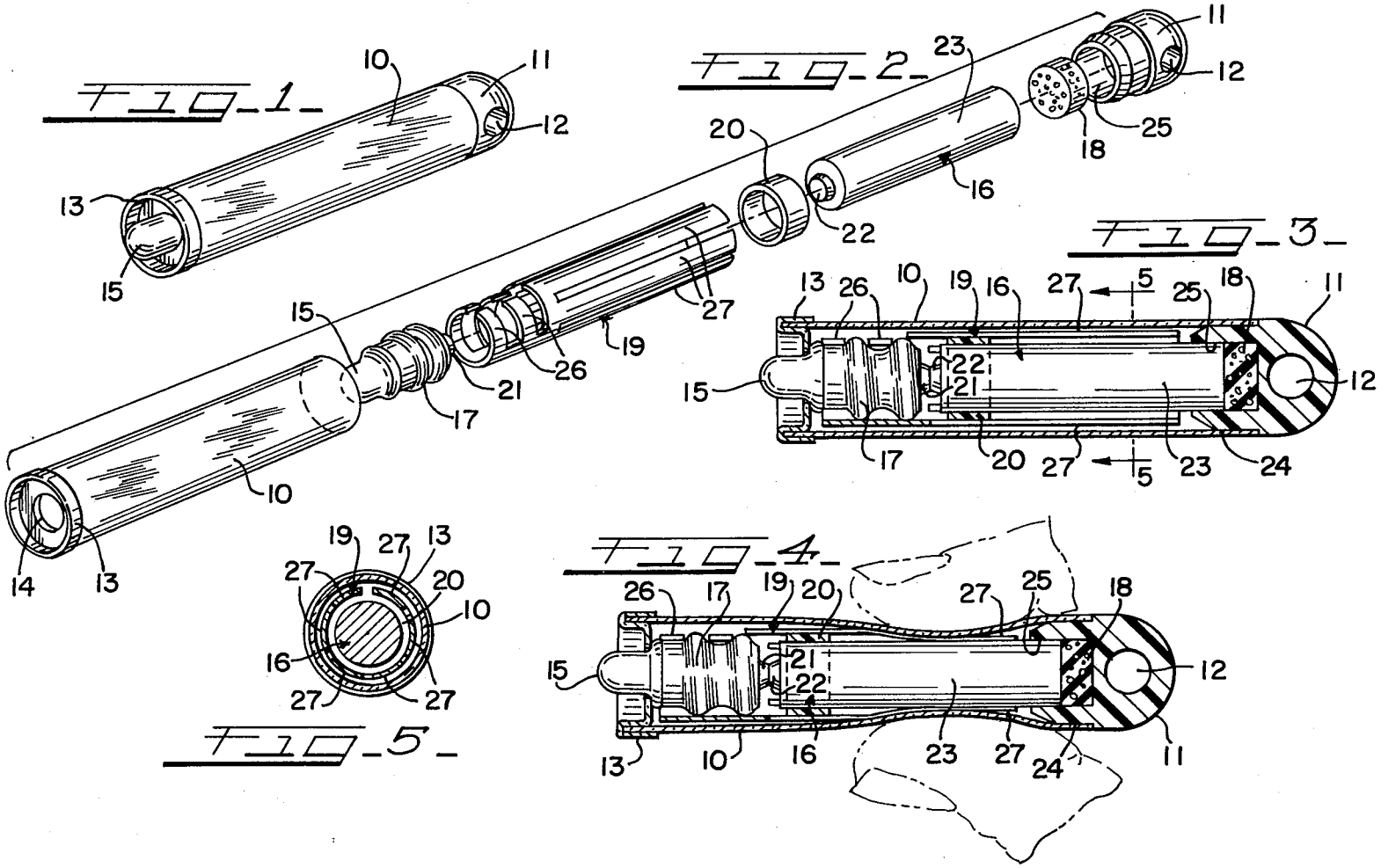
FIG. 1 is a general perspective view of a complete flashlight fully assembled as it would be assembled for actual use.
FIG. 2 is an exploded perspective view of the various flashlight parts spaced apart in the relationship that they might assume just prior to final assembly.
FIG. 3 is a longitudinal sectional view showing the flashlight in normal relaxed condition prior to being compressed for lighting.
FIG. 4 also is a longitudinal sectional view similar to FIG. 3 but showing the flashlight compressed for completing the electrical circuit from the battery to the light bulb.
FIG. 5 is a transverse sectional view through the flashlight taken on the line 5—5 of FIG. 3.

As can best be seen in FIG. 1, the flashlight of this invention includes an outer shell, or container 10, having a rear closure plug 11 which is provided with an opening 12 by means of which the flashlight may be suspended, as on a chain, or a ring, or the like and a front end cap 13 having a central opening 14 for a light bulb 15. The shell 10 is made from a suitable plastic material, which can be transparent for see-through ability whereby an advertising card of cylindrical configuration can be inserted and include the identity of a supplier who might distribute the flashlight as a give-away item. The plastic shell 10 is flexible and the flashlight is adapted to be lighted merely by compressing, or squeezing this shell, as will hereinafter appear. The front end cap 13 is made from a suitable plastic material also.

The container 10 encloses all of the elements of the flashlight between the plastic front end cap 13 and the rear end plug 11 and these elements include the battery 16, a light bulb structure 17, a resilient pressure device 18, a metal clip structure 19 and a dielectric ring 20. The bulb structure 17 includes a rear metal contact 21 for engagement with the anode 22 of the battery, which is not insulated on its exterior so that the bare metal can 23 comprises the negative pole of the battery while the anode 22 acts as the positive pole. The plug 11 functions as a rear end closure, or cap and has a forwardly disposed portion of reduced diameter that extends into the rear of the container 10, as at 24. The rear plug is hollow which affords an internal recess 25.

The resilient pressure device 18 is disposed in the recess 25 and presses against the rear end of the battery 16, the rear portion of which extends into the recess 25 in front of the resilient member 18 so that the member 18, which may be comprised of a suitable foam material, or a cotton bat, will act to urge the battery axially, or forwardly of the container 10. The battery adjacent its front end, is supported in the dielectric ring 20 so that is is fully insulated from the metal clip 19 and the container, which of course, becomes necessary inasmuch as the battery can 23 is completely exposed without benefit of an insulating covering, as normally found with most batteries of the type utilized in this flashlight. The end plug 11 is made from a suitable material such as a non-conducting plastic so that the battery is fully shielded from its enclosure.

The battery 16 seats against the resilient bat 18 which, being under compression, urges the battery forwardly to maintain the anode 22 in engagement with the metal contact 21 forming a part of the bulb structure 17 which is also mounted in the metal clip 19. This metal clip has generally circular spring action fingers 26 that are adapted to grip the bulb structure 17 to hold the bulb 15 in place, but are flexible whereby the bulb structure can be pushed into the clip with the fingers yielding sufficiently for this purpose then contracting to tightly engage the bulb and hold it with the bulb portion 15 projecting through the end cap opening 14.

The metal clip 19 also includes a plurality of lengthwise extending flexible fingers 27 that are disposed at spaced intervals about the bare battery can 23 and it is by means of these fingers that an electrical circuit is completed to energize the light bulb. The fingers 27 normally are disposed out of engagement with the bare battery can 23, but being flexible, can be brought into contact with the can 23 when the flexible outer shell 10 is squeezed, or compressed, whereupon the fingers 27 are pressed into engagement with the battery at any one or more positions to provide a completed circuit to the bulb 15 with the fingers 27 comprising one side of the circuit from the negative pole 23 of the battery and the anode 22 comprising the positive pole and thereby energizing the circuit to light the bulb 15.

From the foregoing, it can be seen that a simply acting flashlight has been provided that can be actuated by merely squeezing the flexible outer shell of the flashlight to press one or more internal fingers into contact with an exposed negative battery pole to complete a lighting circuit through such pole and a positive pole in contact with a light bulb. The flashlight is made largely of plastic materials, certain of which may be transparent whereby an advertising piece may be inserted into the flashlight. The flashlight is of economical manufacturing costs whereby it can be utilized as a give-away advertising item and may be disposable as well.

We claim:

1. A flashlight including a battery, a bulb and an outer shell, said outer shell comprising a container for the battery and bulb, said battery being uninsulated with the metal can exposed throughout a major portion of its length, a generally cylindrical metal clip in the container surrounding the battery and having a plurality of spaced fingers extending lengthwise of the battery at spaced intervals around the battery, said container being flexible and made from a non-conducting plastic material, said container being compressible laterally to engage said metal clip and press one or more of said fingers into contact with said battery can to complete an energizing circuit to said bulb, a rear end cap or plug closing the rear end of the container, and a dielectric ring surrounding said battery which insulates a negative pole of the battery from said cylindrical metal clip, said battery supported at one end in said dielectric insulating ring and at its opposite end in said rear end cap, or plug.

2. A flashlight as set forth in claim 1 wherein said bulb is mounted in said clip and extends through the front end of said container, said bulb having a base structure in contact with an anode of said battery.

3. A flashlight as set forth in claim 2 wherein said container includes a resilient pressure device between the battery and the rear of the container, said device exerting axial pressure on the rear end of said battery, and which comprises a non-metallic bat of material under sufficient pressure to maintain said anode in constant contact with said bulb base structure.

4. A flashlight as set forth in claim 2 wherein said cylindrical clip includes one or more spring fingers surrounding and gripping said base structure to position the bulb in said container.

5. A flashlight as set forth in claim 3 wherein said non-metallic bat is disposed in said rear end cap, or plug and said plug incorporates an opening therethrough for suspension of the flashlight.

* * * * *